United States Patent [19]

Yoshida

[11] Patent Number: 4,984,023

[45] Date of Patent: Jan. 8, 1991

[54] TONER CARTRIDGE

[75] Inventor: Tatsuya Yoshida, Saitama, Japan

[73] Assignee: Asahi Kogaku Kogyo Kabushiki Kaisha, Tokyo, Japan

[21] Appl. No.: 506,828

[22] Filed: Apr. 10, 1990

[30] Foreign Application Priority Data

Apr. 12, 1989 [JP] Japan ..... 1-42672[U]

[51] Int. Cl.[5] ..... G03G 15/06

[52] U.S. Cl. ..... 355/260

[58] Field of Search ..... 355/260, 208, 245, 200, 355/256, 326, 327; 118/653; 206/316.1, 316.2, 316.3, 218

[56] References Cited

U.S. PATENT DOCUMENTS 4,491,161 1/1985 Tamura et al. ..... 355/260 X
4,862,210 8/1989 Woolley ..... 355/245
4,912,512 3/1990 Midorikawa et al. ..... 355/260

FOREIGN PATENT DOCUMENTS 0186284 8/1987 Japan ..... 355/260
63-244077 10/1988 Japan .
0209464 8/1989 Japan ..... 355/260

OTHER PUBLICATIONS

Copy of English Language Abstract of Japanese Publication No. 63-244077.

*Primary Examiner*—A. T. Grimley
*Assistant Examiner*—Sandra L. Hoffman
*Attorney, Agent, or Firm*—Sandler, Greenblum & Bernstein

[57] ABSTRACT

In a toner cartridge for containing toner utilized in a developing unit of an imaging device of the electrophotographic type, a containing part comprises a foldable material such as vinyl. Thus, the container is folded after toner is supplied to the developing unit. Accordingly, the space for the container filled with toner is prevented from becoming dead space. Further, if the material of the container is transparent, it is possible to detect whether or not toner remains inside of the container.

9 Claims, 4 Drawing Sheets

TONER CARTRIDGE

BACKGROUND OF THE INVENTION

The present invention relates to a toner cartridge detachably fitted to a developing unit employed in an imaging device and the like utilizing the so-called electrophotographic system, and used for supplying toner stored therein to the developing device. More particularly the invention relates to a toner cartridge capable of reducing the space occupied by an empty toner cartridge after use and therefore decreasing the size of an imaging device by minimizing a dead space.

Conventionally, electronic copying machines, laser printers and the like are well known as imaging device utilizing the electrophotographic system.

The Electrophotographic system is a technique comprising the steps of employing photoconductive material, i.e., photosensitive material, to make a photoconductive drum, exposing to the photoconductive drum light to from a latent image the surface of the photoconductive drum uniformly being charged with electricity, adhering toner to the latent image to develop a visible image, i.e., toner image, transferring the toner image to a recording sheet and simultaneously fixing the toner image thereto by means of a fixing unit, and discharging the recording sheet on which the visible image corresponding to the latent image is formed.

The developing unit for performing the developing operation is generally formed as a unit based on its function. The unit is arranged to provide the surface of the photoconductive drum with toner via developing rollers or the like by charging the toner stored in a toner chamber.

However, as toner is consumed during the above developing operation, it has to be supplied to the toner chamber, in accordance with the volume consumed. Although toner can simply be supplied to the toner chamber directly from a toner container, it tends to fly apart or float in air and may stain hands and clothing.

Due to this problem, as illustrated in FIG. 1, a toner cartridge 30 containing toner is fitted to a developing unit 20. The toner cartridge 30 is made of rigid material such as plastic and the like and formed into a container detachable from the developing unit 20. In many cases where toner is supplemented, the used cartridge, i.e., the empty cartridge, fitted to the developing unit 20 is removed before being replaced with a new cartridge to supply the toner contained in the new cartridge to the developing unit 20. In other words, the toner cartridge 30 is normally fitted into a supply gate led to the developing unit 20 and the toner cartridge 30 after the contents are emptied out therefrom is used to function as a cover for the toner supply gate.

With the above arrangement, however, the toner cartridge 30, though empty after the contents are emptied into the developing unit 20, still remains installed in the developing unit 20 as if it were loaded with toner. As a result, the space occupied by the toner cartridge 30 becomes so-called dead space, thus providing an obstacle to reducing the size of the imaging device.

SUMMARY OF THE INVENTION

It is therefore an object of the invention to provide an improved toner cartridge capable of minimizing the space occupied by an empty cartridge after use and therefore decreasing the entire size of an imaging device by curtailing the dead space.

For this purpose, according to the present invention, there is provided a toner cartridge arranged to be attachably and detachably mounted on a developing unit adapted to be positioned in an imaging device of the electrophotographic type.

The toner cartridge includes a container, made of a predetermined bendable material, for containing toner; and a base including an engagement portion arranged to be brought into engagement with a predetermined portion of said developing unit and a holding member, detachablly provided on said base, for holding toner in said container.

DESCRIPTION OF THE ACCOMPANYING DRAWINGS

DESCRIPTION OF THE EMBODIMENTS

Figure 1:
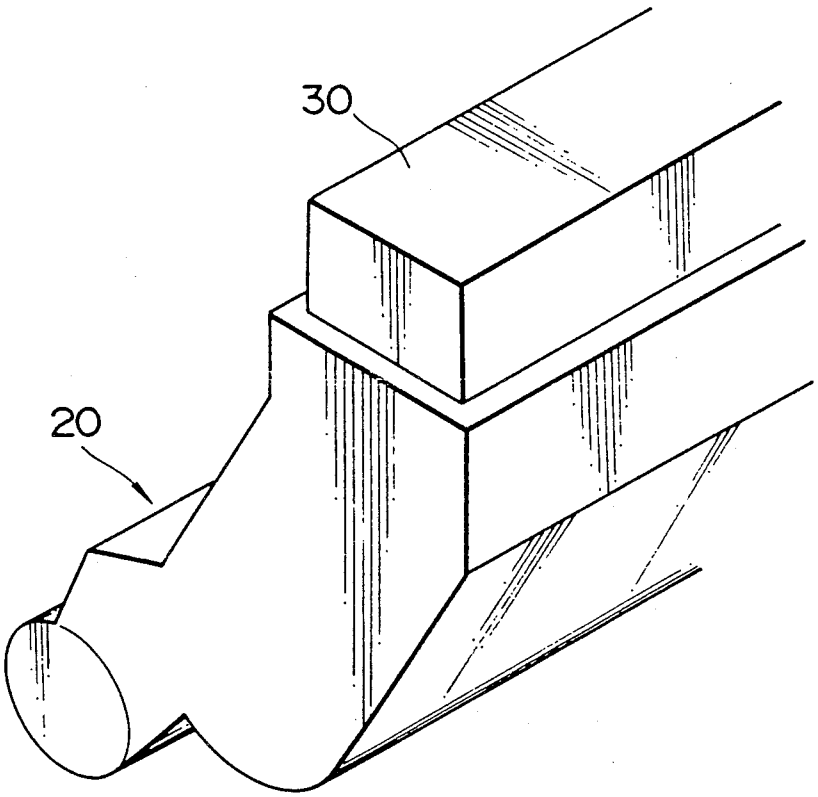
FIG. 1 (PRIOR ART)
FIG. 1 is a perspective view of a conventional toner cartridge fitted to a developing unit.

Referring to the drawings, an embodiment of the present invention is described hereinafter.

Figure 2A:
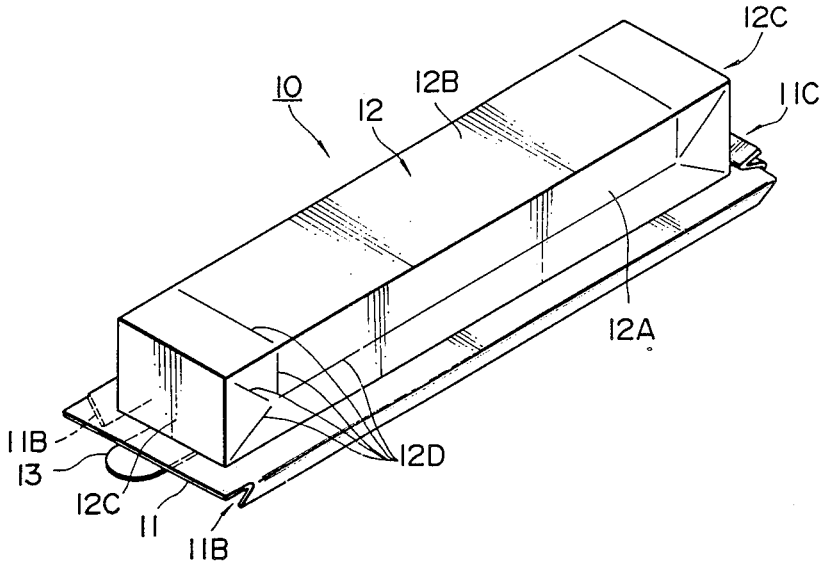
FIG. 2A is a perspective view of a toner cartridge wherein toner is contained embodying the present device.
Figure 2B:
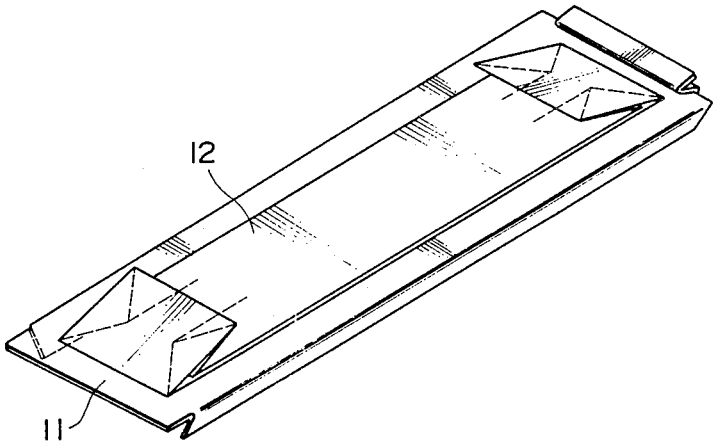
FIG. 2B is a perspective view of the toner cartridge folded down after the toner has been supplied to a developing unit.
Figure 3:
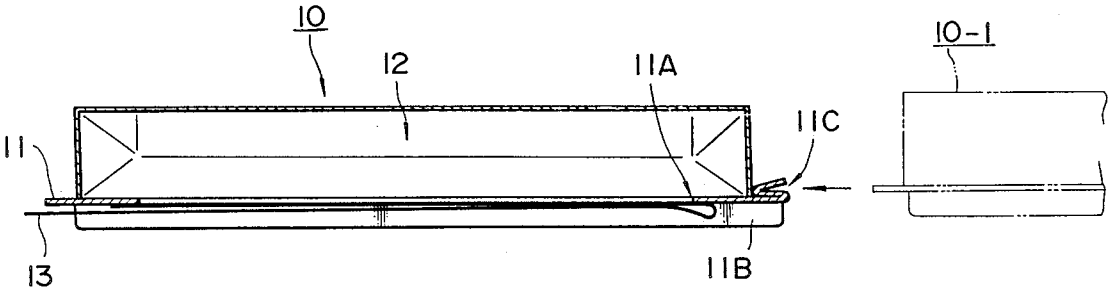
FIG. 3 is a vertical sectional view of the toner cartridge illustrated in FIG. 2A.

FIGS. 2A and 2B are perspective views of a toner cartridge embodying the present invention, and FIG. 3 is a vertical sectional view of the toner cartridge illustrated in FIG. 2A.

As shown in the drawings, a toner cartridge 10 comprises a base plate 11 made of a material such as a plastic plate or cardboard having predetermined thickness and rigidity, and a toner container 12 made of flexible material such as vinyl or the like, the toner container being integrally coupled to the surface of the base plate.

The base plate 11 is a rectangular plate and has a through-hole 11A in the central part for communicating between the inside and outside of the toner container 12.

Both the longitudinal side ends of the base plate 11 are formed as guiding and reinforcing parts 11B foldable at a predetermined angle downward, i.e., to opposite side of the toner container 12. On one of the short edges orthogonal to the guiding and reinforcing parts 11B is formed as a mating part 11C foldable at a predetermined angle upward to be parallel to the base plate 11 and foldable in the direction opposite to the down folding direction.

The toner container 12 formed with a transparent vinyl sheet is placed on the base plate 11 in the form of a rectangular bag whose size is smaller by a predetermined amount than the base plate 11 and integrally coupled to the surface of the base plate 11, the through-hole 11A serving to communicate between the inside and outside thereof.

The longitudinal sides 12A and the upper surface 12B have lines of flection 12D for folding so that in the condition without toner, i.e., in the emptied state, the container can easily be folded down flat as illustrated in FIG. 2B in such a manner that the longitudinal side 12A is conduplicated inward in a collapsing motion, each of the edge faces 12C being folded in the direction opposite to each other.

The material of the toner container 12 is not limited to a vinyl sheet but any other material such as paper, including those deformable to undefined shapes, can be used as long as it is thin and bendable. As to its transparency, though the material is not necessarily transparent, transparent material has an advantage in that whether or not toner left inside is easily detectable.

The toner cartridge 12 is filled with toner thereafter the through-hole 11A is covered with a seal 13 adhering to the underside of the base plate 11.

The seal 13 after being used to cover the through-hole 11A of the base plate 11, is inversely folded in the longitudinal direction and guided to the other opposite side. By pulling drawing the end of the seal 13, it can be detached from the base plate 11 to open the through-hole 11A.

Figure 4:
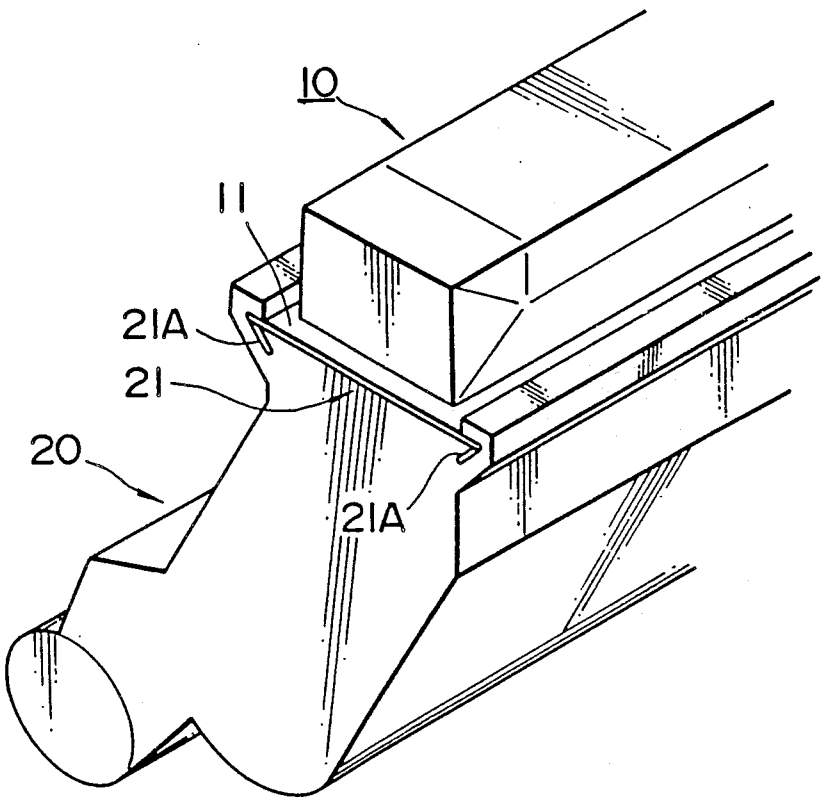
FIG. 4 is a perspective view of the toner cartridge fitted to a developing unit.

The toner cartridge 10 configured as above is fitted to cartridge-fitting section 21 formed on the upper side of the toner chamber of the developing unit 20 by fitting the base plate 11, as illustrated in FIG. 4.

More specifically, guide grooves 21A are formed in the cartridge-fitting section 21 and, the guiding and reinforcing parts 11B at both ends of the base plate 11 in the longitudinal direction are slidable in the guide grooves, respectively. By sliding the guiding and reinforcing parts 11B in the guide grooves 21A from the side end of the developing unit 20, the toner cartridge 10 can be fitted to the developing unit 20 in proper position.

When a new toner cartridge is fitted, naturally with the used toner cartridge unremoved, the new cartridge is fitted and slid in the guide grooves 21A from one side end of the developing unit 20, so that the used cartridge is pushed by the new cartridge, out of the other end thereof.

In this embodiment, the mating part 11C is formed at one side perpendicular to the sliding direction of the base plate 11. The end portion without the mating part 11C mates with the mating part 11C to ensure that the used cartridge is pushed out by the new one. In other words, as shown by an imaginary line of FIG. 3, for instance, the other end of the base plate 11 of the new cartridge 10-1 mates with the mating part 11C of the used cartridge, i.e., the cartridge designated by 10 in the drawing, to push out the latter.

With the above arrangement, if an envelope or the like for receiving the used cartridge is applied to the cartridge-fitting section 21 of the developing unit 20 from which side the used cartridge is pushed out, the used cartridge can be discharged into the envelope without staining the hand of the operator when the new cartridge is fitted, that is, the replacement of the used cartridge can be made without staining the hand.

After the toner cartridge 10 is fitted in position, the seal 13 is detached by pulling it out from the other side, whereby the toner stored in the toner container 12 is supplied via the through-hole 11A to the developing unit 20.

The toner container 12 whose contents have been emptied into the developing unit 20 is folded down along the lines of flection into a thin shape as shown in FIG. 2B. The space occupied by the used cartridge is thus prevented from remaining and becoming dead space.

The toner container 12 need not always be provided with the line of flection but may be arranged so that it is bendable and deformable into an undefined thin shape when pressed or compressed by a cover or the like located thereabove.

As described above, the toner cartridge according to the present invention is provided with the toner container thinly foldable after the toner contained therein has been emptied into the developing unit and the space containing the toner is prevented from becoming dead space, this arrangement thus contributes to reducing the imaging device in size.

What is claimed is:

1. A toner cartridge arranged to be attachably and detachably mounted on a developing unit adapted to be positioned in an imaging device of the electrophotographic type, said toner cartridge comprising:

a container, made of a predetermined bendable material, for containing toner; and a base, including an engagement portion, arranged to be brought into engagement with a predetermined portion of said developing unit, and a holding member, detachably provided on said base, for holding toner in said container.

2. The toner cartridge according to claim 1, wherein said predetermined bendable material comprises vinyl.

3. The toner cartridge according to claim 2, wherein said container is formed in rectangular parallelepiped shape when said container is filled with toner.

4. The toner cartridge according to claim 3, wherein a surface of said container has a plurality of lines of flection for folding, wherein said cartridge can be folded flat when toner is not contained in said container.

5. The toner cartridge according to claim 1, wherein both side edges of said engagement portion along a longitudinal direction of said container are arranged to be slidably engaged with said predetermined portion of said developing unit.

6. The toner cartridge according to claim 1, wherein said holding member comprises a seal, extending along a longitudinal direction of said container, for covering a bottom portion of said container.

7. The toner cartridge according to claim 1, wherein sid predetermined bendable material further is transparent.

8. The toner cartridge according to claim 5, wherein a contact portion is further provided at one end part of said engagement portion perpendicular to said longitudinal direction, whereby said toner cartridge being replaced is pushed by said contact portion.

9. A toner cartridge comprising a container, for containing toner therein, said container arranged to be deformed in case toner is not in said container, said toner cartridge being arranged to be attachably and detachably mounted on a developing unit adapted to be positioned in an imaging device of the electrophotographic type in a predetermined manner.

* * * * *